US005087946A

United States Patent [19]

Dalal et al.

[11] Patent Number: 5,087,946

[45] Date of Patent: Feb. 11, 1992

[54] COMPOSITE INSTANT ON FUSER ELEMENT

[75] Inventors: Edul N. Dalal; Paul C. Swanton, both of Webster, N.Y.

[73] Assignee: The United States of America as represented by Director, National Security Agency, Washington, D.C.

[21] Appl. No.: 533,228

[22] Filed: Jun. 4, 1990

[51] Int. Cl.[5] ..... G03G 15/20

[52] U.S. Cl. ..... 355/285; 219/216

[58] Field of Search ..... 355/284, 285, 290, 295; 219/469, 470, 471, 216, 529, 549; 29/132; 338/225; 428/906

[56] References Cited

U.S. PATENT DOCUMENTS

| | | | |
|---|---|---|---|
| 3,649,810 | 3/1972 | Tsuboi et al. | 219/216 |
| 4,013,871 | 3/1977 | Namiki et al. | 219/471 |
| 4,087,676 | 5/1978 | Fukase | 219/216 |
| 4,234,248 | 11/1980 | Beck | 355/282 |
| 4,360,566 | 11/1982 | Shimizu et al. | 428/404 |
| 4,448,872 | 5/1984 | Vandervalk | 355/295 X |
| 4,544,828 | 10/1985 | Shigenobu et al. | 219/216 |
| 4,883,941 | 11/1989 | Martin et al. | 219/216 |
| 4,949,132 | 8/1990 | Chimoto | 355/290 |

*Primary Examiner*—A. T. Grimley
*Assistant Examiner*—Shuk Y. Lee
*Attorney, Agent, or Firm*—John R. Utermohle; Thomas O. Maser

[57] ABSTRACT

A fuser roll including a hollow cylinder having a relatively thin wall, the cylinder being a plastic composition reinforced with a conductive fiber filler, the plastic composition having a resistivity between 0.5 and 0.05 ohm.cm, the cylinder having an outside and an inside surface and enclosing ambient air, a back up roll disposed in an engaging relationship with the outside surface of the hollow cylinder defining said nip, a heating element disposed within said relatively thin wall, the heating element being said conductive fiber filler, the conductive fiber filler also providing the mechanical reinforcement of the hollow cylinder, and an additive, the additive being part of the plastic composition, the additive providing a release layer on the outside surface of the cylinder, the additive being a fluorocarbon at approximately 0.25 percent by weight.

14 Claims, 3 Drawing Sheets

COMPOSITE INSTANT ON FUSER ELEMENT

BACKGROUND OF THE INVENTION

This invention relates to an improved fuser apparatus and more particularly to a composite fusing element.

In order to fuse toner material permanently onto a support surface by heat, it is usually necessary to elevate the temperature of the toner material to a point at which the constituents of the toner materials coalesce and become tacky. This heating causes the toner to flow to some extent into the fibers or pores of the support member. Thereafter, as the toner material cools, solidification of the toner material causes the toner material to become firmly bonded to the support member.

PRIOR ART

The use of thermal energy for fixing toner images onto a support member is well known. Several approaches to thermal fusing of electroscopic toner images have been described in the prior art. These methods include providing the application of heat and pressure substantially concurrently by various means, for example, a roll pair maintained in pressure contact, a flat or curved plate member in pressure contact with a roll, and a belt member in pressure contact with a roll.

Prior art fusing systems have been effective in providing the fusing of many copies in relatively large fast duplicating machines, in which the use of standby heating elements to maintain the machine at or near its operating temperature can be justified. However, there is a continuing need for an instant-on fuser which requires no standby power for maintaining the fuser apparatus at a temperature above the ambient. It is known to use a positive characteristic thermistor having a self temperature controlling property as a heater for a heating roller. The roller is regulated to a prescribed temperature by a heating control temperature detection element. It is also known to employ radiation absorbing materials for the fuser roll construction to effect faster warm-up time and to use an instant-on radiant fuser apparatus made of a low mass reflector thermally spaced from a housing, with the housing and the reflector together forming a conduit for the passage of cooling air therein. It is also known to use a cylindrical member having a first layer made of elastomeric material for transporting radiant energy, a second layer for absorbing radiant energy, and a third layer covering the second layer to affect a good release characteristic on the fuser roll surface. The fuser roll layers are relatively thin and have an instant-start capability. It is also known to use an instant-on fuser having a core of metal or ceramic supporting a fuser roller, and including a heat insulating layer, an electrically insulating layer and a protective layer formed on the outer circumference of the core.

In addition, U.S. Pat. No. 4,234,248 to Beck discloses a hot roll fuser for use in an electrostatic copying machine whose outer surface comprises graphite with less than 0.5 percent carbon. The hot roll fuser comprises a material having sufficient thermal conductivity to avoid long periods of fuser warm up. Due to the physical characteristics of graphite, the application of a supplementary release agent is therefore, eliminated. U.S. Pat. No. 4,360,566 to Shimizu et al. discloses a heat fixing roll, for fusing electrographic dry toner, which includes an outer layer of silicone rubber and contains reinforcing silica filler. U.S. Pat. No. 4,544,828 to Shigenobu et al. discloses a heating device utilizing ceramic particles as a heat source and adapted for use as a fixing apparatus in an electrostatic printing machine or the like. U.S. Pat. No. 4,883,941, assigned to the same assignee as the present invention, discloses an instant on fuser roll having a heating foil secured to the outside surface of the fuser cylinder.

A difficulty with the prior art fusing systems is that they are often relatively complex and expensive to construct and/or the mass of the system is relatively large to preclude an instant-start fusing capability. Another difficulty is that prior art fuser rolls are not always easily adapted to provide sufficient mechanical strength and heating characteristics. It is an object of the present invention, therefore, to provide a new and improved fuser apparatus that comprises a conductive fiber reinforced plastic cylinder providing the heating element. It is another object of the present invention to provide fuser apparatus that has a relatively low thermal mass and is designed for relatively ease of construction, in particular, a single molding process to provide a cylinder with both mechanical and electrical properties.

Further objects and advantages of the present invention will become apparent as the following description proceeds and the features of novelty characterizing the invention will be pointed out with particularity in the claims annexed to and forming a part of this specification.

SUMMARY OF THE INVENTION

The present invention is concerned with fuser roll including a hollow cylinder having a relatively thin wall, the cylinder being a plastic composition reinforced with a conductive fiber filler, the plastic composition having a resistivity between 0.5 and 0.05 ohm.cm, the cylinder having an outside and an inside surface, a source of thermal energy affixed to the surface of the cylinder, a back up roll disposed in an engaging relationship with the outside surface of the hollow cylinder defining said nip, a heating element disposed within said relatively thin wall, the heating element being said conductive fiber filler, the conductive fiber filler also providing the mechanical reinforcement of the hollow cylinder, and an additive, the additive being part of the plastic composition, the additive providing a release layer on the outside surface of the cylinder, the additive being a fluorocarbon at approximately 0.25 percent by weight.

BRIEF DESCRIPTION OF THE DRAWINGS

For a better understanding of the present invention, reference may be had to the accompanying drawings, wherein the same reference numerals have been applied to like parts and wherein.

DESCRIPTION OF THE INVENTION

Figure 1:
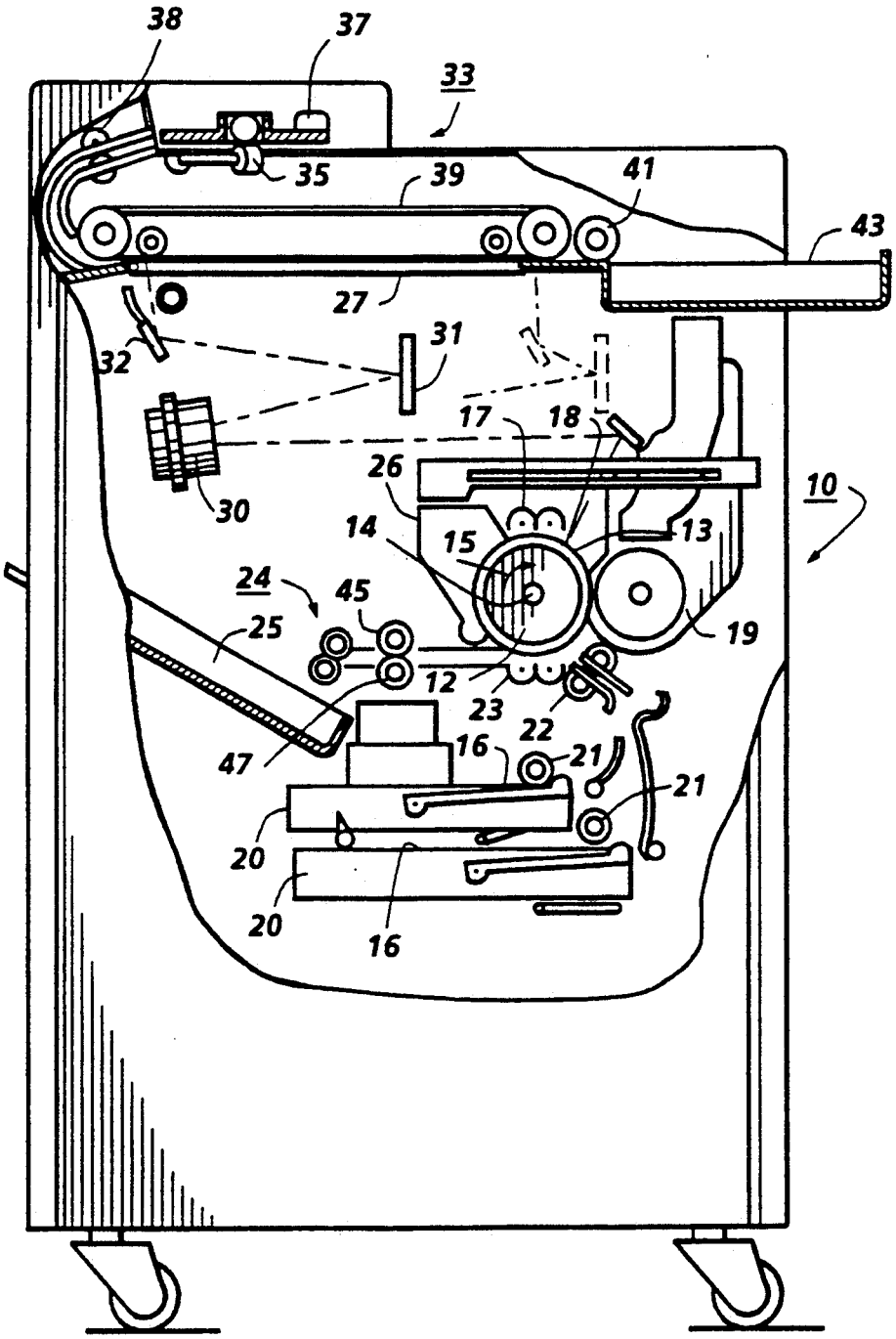
FIG. 1 PRIOR ART
FIG. 1 is an illustration of a reproduction machine incorporating the present invention.

Referring now to FIG. 1, there is shown by way of example an automatic xerographic reproducing machine 10 including an image recording drum like member 12, its outer periphery coated with suitable photoconductive material. The drum 12 is suitably journalled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input information is recorded upon a sheet of final support material or copy sheet 16.

Initially, the drum 12 moves the photoconductive surface 13 through a charging station 17 providing an electrostatic charge uniformly over the photoconductive surface 13 in known manner preparatory to imaging. Thereafter, the drum 12 is rotated to exposure station 18 and charged photoconductive surface 13 is exposed to a light image of the original document to be reproduced. The charge is selectively dissipated in the light exposed regions to record the original document in the form of an electrostatic latent image. After exposure drum 12 rotates the electrostatic latent image recorded on photoconductive surface 13 to development station 19 wherein a conventional developer mix is applied to the photoconductive surface 13 of the drum 12 rendering the latent image visible. Typically, a suitable development station could include a magnetic brush development system utilizing a magnetizable developer mix having coarse ferromagnetic carrier granules and toner colorant particles.

The copy sheets 16 of the final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16.

After the toner image has been transferred to the sheet of final support material or copy sheet 16, the sheet with the image is advanced to fusing station 24 for coalescing the transferred powder image to the support material. After the fusing process, the copy sheet 16 is advanced to a suitable output device such as tray 25.

Although a preponderance of toner powder is transferred to the copy sheet 16, invariably some residual toner remains on the photoconductive surface 13. The residual toner particles remaining on the photoconductive surface 13 after the transfer operation are removed from the drum 12 as it moves through a cleaning station 26. The toner particles may be mechanically cleaned from the photoconductive surface 13 by any convenient means, as for example, by the use of a cleaning blade.

Normally, when the copier is operated in a conventional mode, the original document to be reproduced is placed image side down upon a horizontal transparent platen 27 and the stationary original then scanned by means of a moving optical system. The scanning system includes a stationary lens 30 and a pair of cooperating movable scanning mirrors, half rate mirror 31 and full rate mirror 32 supported upon suitable carriages.

A document handler 33 can also be provided including registration assist roll 35 and switch 37. When a document is inserted, switch 37 activates registration assist roll 35 and the document is fed forward and aligned against a rear edge guide for the document handler 33. The pinch rolls 38 are activated to feed a document around 180° curved guides onto the platen 27 for copying. The document is driven by a platen belt transport including platen belt 39. After copying, the platen belt 39 is activated and the document is driven off the platen by the output pinch roll 41 into the document catch tray 43.

The fusing station 24 includes a heated fuser roll 45 and a back up or pressure roll 47 forming a nip through which the copy sheets to be fused are advanced. The copy sheet is stripped from the fuser rolls by suitable (not shown) stripper fingers. The pressure roll 47 comprises a rotating member suitably journaled for rotation about a shaft and covered with an elastomeric layer of silicone rubber, PFA or any other suitable material. The fuser roll 45 comprises a rotating cylindrical member 48 mounted on a pair of end caps 49 as seen in FIGS. 2 and 3.

To be instant-on, a fuser should achieve operating temperatures in a time shorter than the arrival time of the paper at the fuser, at machine start-up, approximately a 5–10 second warm-up time. This is, assume a copy sheet 16 takes from 5–10 seconds to be transported from the support tray 20 to the transfer station 23 to fuser 24 after a start print or start copy button is pushed. It is usually then necessary for the fuser to be elevated at least 120° C. Raising the temperature of a rigid structure at a change of temperature of approximately 120° C. in five seconds using reasonable power levels, for example, 700 watts requires a small mass to be heated. In accordance with the present invention, the cylindrical, member 48 is a hollow cylinder of fiber glass carbon graphite, or boron carbide fibers or any other suitable fiber material of suitable mechanical strength. Preferably, the thickness of the cylindrical member 48 wall is approximately 20–40 mils. It should be noted that, although very advantageous in an instant on fuser, the present invention is applicable to any type of fuser apparatus requiring combined mechanical and heating characteristics.

Figure 2:
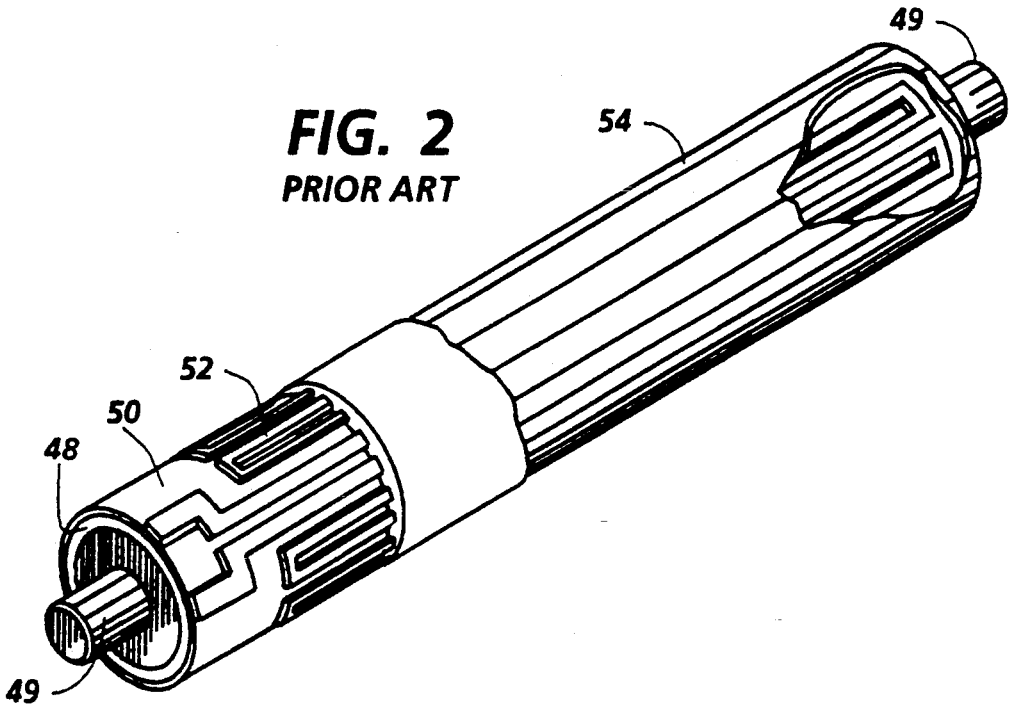
FIG. 2 PRIOR ART
FIGS. 2 and 3 illustrate a prior art fusing element.
Figure 3:
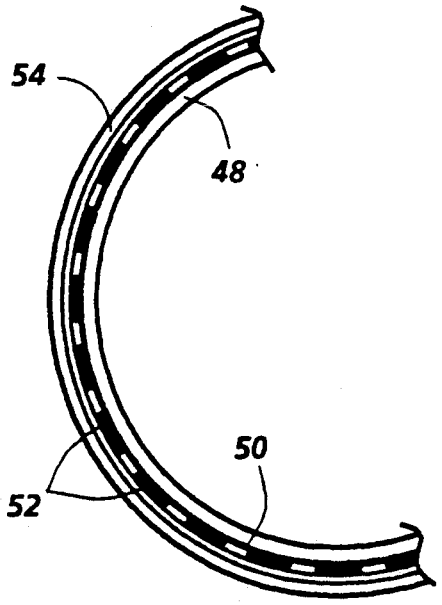
FIG. 3 PRIOR ART

With reference to prior art, FIGS. 2 and 3, supported on the filament wound cylindrical member 48 is a poly adhesive securing fiber glass backing 50. Supported on the fiber glass backing 50 is suitable heating wire, printed circuit or photo etched circuit pattern 52. A suitable release agent 54 such as PFA or rubber covers the heating element.

It is important for the fuser roll to have sufficient mechanical strength including hoop strength and beam strength. The hoop strength is the property of the fuser roll core material to resist inward radial pressure and beam strength is the property of the fuser roll core material to resist bending. It is also known in the prior art to use a filament wound tube or cylinder with the fibers wound at approximately 50 degrees or any other suitable orientation with respect to the longitudinal axis to provide sufficient mechanical strength. However, such filament wound cylinders still require a separate backing and heating element.

Figure 4:
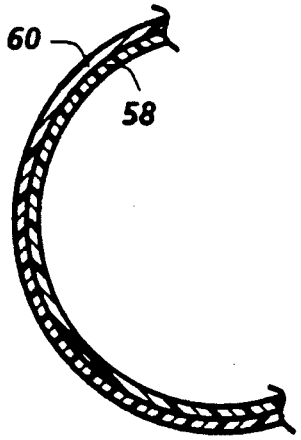
FIG. 4 is an isometric view of the fuser apparatus incorporated in FIG. 1 in accordance with the present invention.

In accordance with the present invention, the need for a separate backing and heating element is eliminated by the use of conductive fillers in the cylinder. As illustrated in FIG. 4, there is a much simpler construction including only a cylinder wall 58 and suitable release agent 60. Using conductive fillers in plastics to make heaters is not new—e.g., cable heaters, sold to prevent water pipes from freezing, are made of carbon-black filled PE or rubber. However, these are typically used at relatively low temperatures. As shown below, such a system can be used in a roll fuser at significantly higher temperatures (up to 400°-450° F.). The data used in these calculations is taken from the Modern Plastics Encyclopedia, Vol. 62, 1985-1986 (hereinafter referred to as MPE).

For thermal stability the following materials (and others) would be suitable:

a) Epoxy:
unfilled, HDT=up to 550° F.
glass filled, HDT=500° F.

b) Polyamide-imide:
Unfilled, HDT=500°-525° F.
glass or graphite filled, HDT=525° F.

c) Carbon fiber: >600° F. (protected from oxidizing atmosphere) (HDT=heat distortion temperature under load)

For electrical resistivity consider a thin-walled tube with dimensions: length=10", outside diameter=1". Let the thickness be t mils, and let the material have a volume resistivity of $\rho$ ohm.cm.

Assume an input power of 650 W. It can be shown that this power is quite adequate.

A heater having the proper electrical resistance along its length to draw 650 W at 110 V, with the above dimensions, will need to have a thickness t (mils) given by $$t=67\rho$$

Thus, using a 20 mil thick tube it will be necessary to use a material having a volume resistivity p=0.3 ohm.cm,. This can be achieved using conventional., readily-aviailable, commercial materials for example, Polyamide-imide (PAI) with 25% Ni-coated carbon fiber, p=0.2 ohm.cm. Considering data for polyamide (PA) instead of PAI:

| | | 15% | 20% | 30% | 40% |
|---|---|---|---|---|---|
| PA + Ni-coated carbon, | p = | 0.5 | 0.1 | 0.05 | 0.02(ohm.cm) |
| PA + carbon | p = | — | 1.4 | 0.7 | —(ohm.cm) |

This demonstrates that any p in the desired (p≈0.3 ohm.cm) can be easily obtained by a judicious blend of Ni-coated carbon with carbon or glass fiber.

For mechanical rigidity, recently it has been demonstrated that a glass-reinforced epoxy tube (OD≈1", length≈10") has more than adequate rigidity at a thickness of 35 mils, and apparently adequate rigidity even at 20 mils. The limiting factor is rigidity; strength is much in excess of requirements. If carbon (graphite) fiber were used instead of glass, the strength would be slightly increased and the rigidity would be increased by almost 2× as demonstrated by the following data from MPE.

| | PAI (unfilled) | PAI + 30% glass | PAI + graphite |
|---|---|---|---|
| Modulus (× $10^6$ psi) | 0.6-0.7 | 1.7 | 2.9 |
| Ultimate Strength (× $10^3$ psi) | 17-27 | 28 | 30 |

Consequently, a 20 mil tube made of carbon-reinforced plastic would be adequately rigid.

The warm up time for such a fuser has been calculated, although it was necessary to estimate values for the thermal conductivity k and thermal diffusivity $\alpha$. By analogy with polyamide date (MPE), $k \simeq 24\times10^{-4}$ cal/(cm.s °C.) and $\alpha \simeq 0.004$ cm$^3$/s for carbon-reinforced PAI was used. The following warm-up response, predicted for an input power of 650 W and dimensions as specified earlier was obtained.

| | Time (sec) to Reach Surface Temp. of | | |
|---|---|---|---|
| | 350° F. | 390° F. | 400° F. |
| a) 20 mil tube | 6.0 | 7.0 | 7.2 |
| b) 35 mil tube | 10.3 | 11.9 | 12.3 |

Thus, 650 W is quite adequate power for a 20 mil tube.

Figure 5:
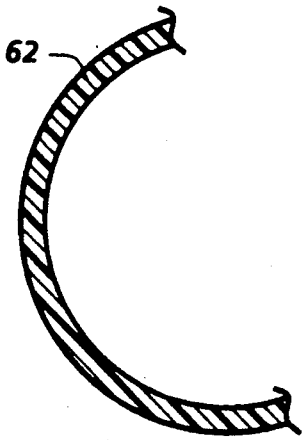
FIG. 5 is an isometric view of the instant-on fuser apparatus incorporated in FIG. 1 in accordance with another aspect of the present invention.

Hot roll fusers need an outer release layer of low-energy material (e.g., Teflon) to prevent molten toner from sticking to it. Such a layer is normally applied by spray or molding techniques, adding significantly to the cost of fabrication. This step, in accordance with another aspect of the present invention, can be eliminated by adding appropriate materials to the bulk of the fuser core before fabrication as shown in FIG. 5. This method is of course not applicable to the typical metallic fuser cores, but should be suitable for the polymeric cores. As illustrated in FIG. 5, a single cylinder wall 62 comprises the heating element, the mechanical rigidity for the wall, and the release agent.

Low energy additives can migrate to a solid surface and drastically lower its surface tension. For instance, 0.25 percent by weight of some fluorocarbon additives drastically reduces the surface tensions of polystyrene, poly(methyl methacrylate), and poly (vinylidene chloride) to about 15-20 dyne/cm, resembling those for pure fluoro-carbon surfaces.

The surfaces of mixtures of two poly(fluoroalkyl methacrylates), differing in fluoroalkyl side chain length, have been investigated by contact angle measurement. The lower-energy component (having a longer fluoroalkyl side chain) is found to concentrate on the surface. In other examples, fluorocarbon polymers are shown to exhibit pronounced surface activity when blended with hydrocarbon polymers. Surface activity of the lower-energy component in a copolymer has also been reported. For further examples see S. Wu, "Polymer Interface and Adhesion", Dekker (1982), p 209-210.

Very small amounts (0.25%) of additives produce drastic reductions in yc in many cases well below that for the classic non-stick polymer Teflon, which has yc≈19 dyn/cm. The resulting surface layer can be made more durable by using polymeric addoitives, or by using additives (monomeric, oligomeric or polymeric) which are bi-segmented, one segment being the low-energy component, the other being compatible with the matrix resin to form an "anchor".

Even if the release layer is applied separately (e.g., a silicone rubber spray) the above concept would provide a means of bonding the rubber by making one of the segments silicone-like, the other resin-like.

While there has been illustrated and described what is at present considered to be a preferred embodiment of the present invention, it will be appreciated that numerous changes and modifications are likely to occur to those skilled in the art, and it is intended in the appended claims to cover all those changes and modifications falling within the true spirit and scope of the present invention.

I claim:

1. In an electrostatic copying machine having fusing apparatus of the type defining a nip through which support material bearing toner images is passed for fusing the toner images onto the support material, the fusing apparatus being raised approximately 120 degrees C. in less than 10 seconds, the fusing apparatus comprising:

a fuser roll including a hollow cylinder having a relatively thin wall, the cylinder being a plastic composition reinforced with a conductive fiber filler, the plastic composition having a resistivity between 0.5 and 0.05 ohm.cm, the cylinder having an outside and an inside surface and enclosing ambient air, a back up roll disposed in an engaging relationship with the outside surface of the hollow cylinder defining said nip, a heating element disposed within said relatively thin wall, the heating element being said conductive fiber filler, the conductive fiber filler also providing the mechanical reinforcement of the hollow cylinder, and an additive, the additive being part of the plastic composition, the additive providing a release layer on the outside surface of the cylinder, the additive being a fluorocarbon at approximately 0.25 percent by weight.

2. The apparatus of claim 1 wherein the plastic composition has a resistivity of approximately 0.3 ohm.cm.

3. The apparatus of claim 1 wherein the plastic composition is Polyamide-imide impregnated with between 15 and 25 percent Ni-coated carbon fiber.

4. The apparatus of claim 1 wherein the additive is a fluorocarbon.

5. In an electrostatic copying machine having fusing apparatus of the type defining a nip through which support material bearing toner images is passed for fusing the toner images onto the support material, the fusing apparatus being raised approximately 120 degrees C. in less than 10 seconds, the fusing apparatus comprising:

a fuser roll including a hollow cylinder having a relatively thin wall, the cylinder being a plastic composition reinforced with a conductive fiber filler, the cylinder having an outside and an inside surface and enclosing ambient air, wherein the plastic composition includes an additive, the additive providing a release layer on the outside surface of the cylinder a back up roll disposed in an engaging relationship with the outside surface of the hollow cylinder defining said nip, and a heating element disposed within said relatively thin wall, the heating element being said conductive fiber filler, the conductive fiber filler also providing the mechanical reinforcement of the hollow cylinder.

6. The apparatus of claim 5 wherein the plastic composition has a resistivity between 0.5 and 0.05 ohm.cm.

7. The apparatus of claim 5 wherein the plastic composition has a resistivity of approximately 0.3 ohm.cm.

8. The apparatus of claim 5 wherein the plastic composition is Polyamide-imide impregnated with between 15 and 25 percent Ni-coated carbon fiber.

9. The apparatus of claim 5 wherein the additive is a fluorocarbon.

10. The apparatus of claim 5 wherein the additive is a fluorocarbon at approximately 0.25 percent by weight.

11. A fusing apparatus of the type defining a nip through which support material bearing toner images is passed for fixing the toner images onto the support material, the fusing apparatus comprising:

a fuser roll including a cylinder having a relatively thin wall, the cylinder being a plastic composition reinforced with a conductive fiber filler, the cylinder having an outside and an inside surface: wherein the plastic composition includes an additive, the additive providing a release layer on the outside surface of the cylinder, the additive being a fluorocarbon at approximately 0.25 percent by weight a back up roll disposed in an engaging relationship with the outside surface of the cylinder defining said nip, and a heating element disposed within said relatively thin wall, the heating element being said conductive fiber filler, the conductive fiber filler also providing the mechanical reinforcement of the hollow cylinder.

12. The apparatus of claim 11 wherein the plastic composition is Polyamide-imide impregnated with between 15 and 25 percent Ni-coated carbon fiber.

13. The apparatus of claim 12 wherein the Ni-coated carbon fiber has a resistivity of approximately 0.03 ohm.cm.

14. The apparatus of claim 11 wherein the additive is a fluorocarbon.

* * * * *

UNITED STATES PATENT AND TRADEMARK OFFICE

CERTIFICATE OF CORRECTION

PATENT NO. : 5,087,946

DATED : May 16, 1990

INVENTOR(S) : Edul N. Dalal and Paul C. Swanton

It is certified that error appears in the above-indentified patent and that said Letters Patent is hereby corrected as shown below:

On the title page: Item [73]: and Item [56]: should read:

Assignee: Xerox Corporation, Stamford, Connecticut
Attorney, Agent or Firm - Ronald F. Chapuran Signed and Sealed this Eighth Day of June, 1993

*Attest:*

Michael K. Kirk

MICHAEL K. KIRK

*Attesting Officer*

*Acting Commissioner of Patents and Trademarks*